US010499741B2

(12) United States Patent
Flancer

(10) Patent No.: US 10,499,741 B2
(45) Date of Patent: Dec. 10, 2019

(54) ADJUSTABLE SLANT BOARD

(71) Applicant: Susan Flancer, Cherry Hill, NJ (US)

(72) Inventor: Susan Flancer, Cherry Hill, NJ (US)

(73) Assignee: Susan Flancer, Cherry Hill, NJ (US)

( * ) Notice: Subject to any disclaimer, the term of this patent is extended or adjusted under 35 U.S.C. 154(b) by 83 days.

(21) Appl. No.: 15/716,601

(22) Filed: Sep. 27, 2017

(65) Prior Publication Data

US 2019/0090638 A1 Mar. 28, 2019

(51) Int. Cl.

| | |
|---|---|
| ***A47C 1/034*** | (2006.01) |
| ***A47C 3/16*** | (2006.01) |
| ***A47C 4/00*** | (2006.01) |
| ***A47C 7/72*** | (2006.01) |

(52) U.S. Cl.

CPC ..... *A47C 1/034* (2013.01); *A47C 3/16* (2013.01); *A47C 4/00* (2013.01); *A47C 7/725* (2013.01)

(58) Field of Classification Search

CPC .. A47C 1/034; A47C 3/16; A47C 4/00; A47C 7/725; A47C 1/031; A47C 1/032; A47C 1/03205; A47C 1/0342; A47C 1/036; A47C 1/037; A61G 5/10; A61G 5/1056; A61G 5/1067; A61G 5/12; A61G 5/14

USPC ..... 5/657, 652

See application file for complete search history.

(56) References Cited

U.S. PATENT DOCUMENTS 696,425 A * 4/1902 Farr ..... A47C 1/146 297/372
2,208,945 A * 7/1940 Miller ..... A47C 17/162 297/170
2,607,050 A * 8/1952 Binschoff ..... A61G 7/1017 5/628
2,614,271 A * 10/1952 Neil ..... B25H 5/00 280/32.6
2,697,480 A * 12/1954 Du Bois ..... A47D 1/002 248/243
3,148,892 A * 9/1964 Merriott ..... B25H 5/00 280/32.6
3,484,878 A * 12/1969 Nielsen ..... A47C 20/043 297/353
3,561,022 A * 2/1971 James ..... A61H 1/0229 482/142
3,949,983 A * 4/1976 Tommasino ..... A63B 23/03575 482/142
5,160,185 A * 11/1992 Stang ..... A47D 13/08 297/377
5,179,746 A * 1/1993 Rogers ..... A61G 1/04 280/47.29

(Continued)

*Primary Examiner* — Joshua E Rodden

(57) ABSTRACT

The Adjustable Slant Board was developed to provide a comfortable alternative to sitting, standing, and lying down. It is a collapsible apparatus that when erect allows the user to stand and recline on a platform. The device includes several sections which provide for the adjustment of the angle of the slant board when in use. Reclining the body in an erect position relieves pressure on the lower back while allowing the user the ability to perform many tasks of daily living. When placed in the most comfortable position, the user is free to watch TV, eat, read, use electronic devices, etc. The collapsibility of the Adjustable Slant Board allows it to be stored out of the way. Slant boards have been used previously in exercise equipment primarily to invert the body A slant board designed to provide a stable platform from which to perform other tasks is novel.

8 Claims, 2 Drawing Sheets

(56) References Cited

U.S. PATENT DOCUMENTS

| | | | | |
|---|---|---|---|---|
| 6,029,669 | A * | 2/2000 | Hammock | A61G 7/065<br>128/845 |
| 6,805,409 | B2 * | 10/2004 | Parker | A47C 9/002<br>297/158.4 |
| 8,584,283 | B2 * | 11/2013 | Mabry | A47C 16/00<br>190/2 |
| 9,233,041 | B2 * | 1/2016 | Iheoma | A61G 13/00 |
| 2002/0108178 | A1 * | 8/2002 | Francois | A45D 29/00<br>5/648 |
| 2005/0085722 | A1 * | 4/2005 | Waterman | A47C 20/027<br>600/427 |
| 2008/0052829 | A1 * | 3/2008 | De Vries | A61B 6/0442<br>5/601 |

* cited by examiner

FIG 1
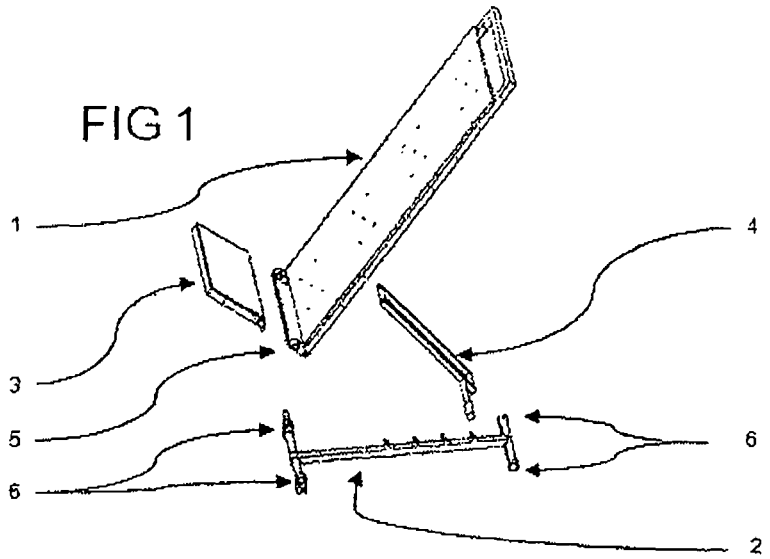
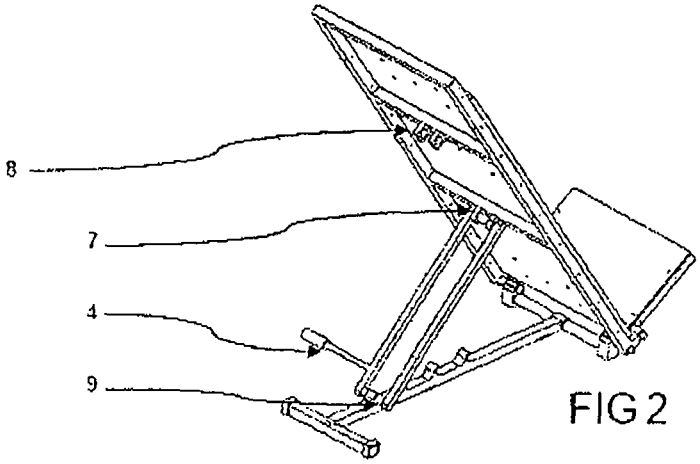
FIG 2
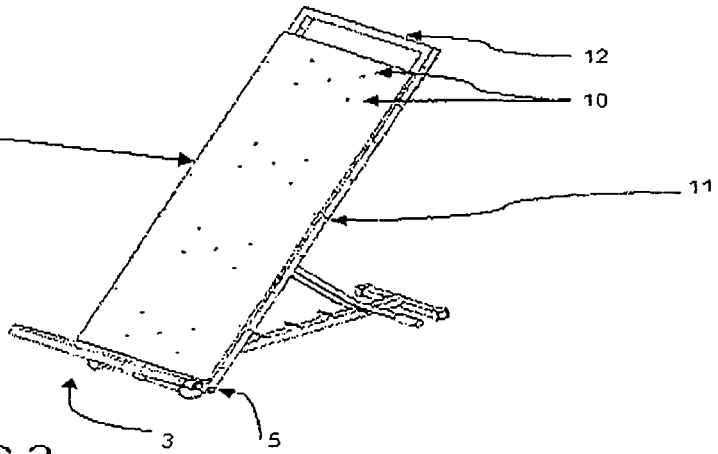
FIG 3

ADJUSTABLE SLANT BOARD

CROSS REFERENCE TO RELATED APPLICATIONS

Not Applicable

FEDERALLY SPONSORED RESEARCH

Not Applicable

CD APPENDIX

Not Applicable

BACKGROUND OF THE INVENTION

The negative effects of prolonged sitting and standing have long been recognized. Many devices have been created in efforts to reduce the resulting back pain and relieve pressure on the spine. Desks have been designed that can be raised up so that sedentary workers can stand and continue working. Exercise equipment that inverts the body where a person's feet are elevated above the head has been touted as elongating the spine and relieving pressure on the vertebrae. While using these devices can be beneficial, they also have limitations.

PRIOR ART

U.S. Pat. No. 3,589,715A—Slant board can only be used for inversion. It is unable to be used in an upright position.

U.S. Pat. No. 3,561,022A—In upright position weight is on heels of user. The apparatus does not have functional reclining positions.

20070093367—Back treatment table with user adjustments elevates feet of user higher than head.

BRIEF SUMMARY OF THE INVENTION

The Adjustable Slant Board is not for inversion, but rather to offer options for multiple positions while the body is erect yet at rest. The Adjustable Slant Board is a platform on which the user can more comfortably relax and also perform tasks associated with sitting, i.e. eating, watching television, reading, and playing video games. The Adjustable Slant Board is an alternative to a chair or sofa when sitting is uncomfortable.

The Adjustable Slant Board provides a rigid, wide panel for strong back support. By adjusting the angle of the panel, the user is able to achieve the maximum amount of comfort, relieving pressure from the lower spine. A folding foot rest attached to the bottom of the panel provides stability for the user while allowing the feet to move freely. It folds upwards for compact storing. The user adjusts the slant board to the preferred angle, steps up on the footrest, and leans back.

Holes are strategically placed on the panel for the addition of accessories such as a reading light, folding table, battery charger, and cup holder, to name a few.

A wide rigid panel is attached with a hinge to a notched stable base. Non slip ends on said base add to stability. A swinging handled bar attached to the back surface of the panel allows the user to select the preferred notch and place it into the base thus changing the slant of the panel. By disengaging said handled bar from the notched base and securing it to clips attached to the back of the panel, the adjustable slant board collapses flat. It can now be easily stored out of sight under furniture or hung by a handle at the top of the panel.

BRIEF DESCRIPTION OF THE DRAWINGS

FIG. 1 shows an unassembled adjustable slant board.

FIG. 2 shows a rear view of the adjustable slant board erected for use.

FIG. 3 depicts the front view of said device with strategically placed holes in the front and side surfaces of a rigid panel for the optional addition of accessories. A folding footrest platform is shown folded down for use. A handle is located atop said rigid panel for hanging said device when stored upright.

DETAILED DESCRIPTION OF THE INVENTION

Figure 4:
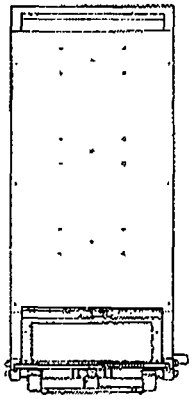
FIG. 4 shows a collapsed device in an upright position suitable for hanging storage.

FIG. 1 shows an unassembled adjustable slant board. The device consists of: a rigid panel 1 with front, back, and side surfaces 1; a notched stable base 2 with non-slip pads 6; a hinged, folding footrest platform 3 and 5; and a handled bar 4.

FIG. 2 shows a rear view of the adjustable slant board erected for use. A handled bar 4 is attached to the back surface of a panel via a hinge 7. Clips 8 are also attached to the back surface of said panel 8. These clips secure said handled bar when said device is not in use. Said handled bar 4 pivots upward to secure in the clips 6, thus collapsing the device. The device is erected by removing the handled bar 4 from the clips 8 and placing it a selected notch 9 in a base 2. The user adjusts the angle of the slant of the panel by selecting a desired notch in said base. Said notched base 9 has non slip ends 6 to prevent the device from sliding.

FIG. 3 depicts a front view of said device showing the rigid panel 1 with strategically placed holes 10 and 11 in front and side surfaces for the optional addition of accessories. Said rigid panel 1 provides a sturdy support surface. A folding footrest platform 3 is shown folded down for use. It is attached to the bottom of said panel 1 via a hinge 5 and folds downward for use and upward for a more stream-lined configuration when said device is collapsed.

FIG. 4 shows a collapsed device in an upright position suitable for hanging storage behind a door or in a closet.

Figure 5:
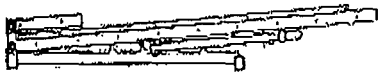
FIG. 5 is a side view of a collapsed device.

FIG. 5 shows a side view of a collapsed device.

Figure 6:
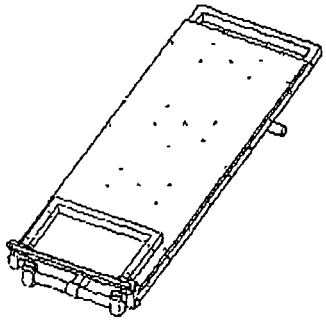
FIG. 6 depicts the adjustable slant board lying flat for storage under furniture.

FIG. 6 shows a frontal view of a collapsed device lying flat for storing under furniture.

Figure 7:
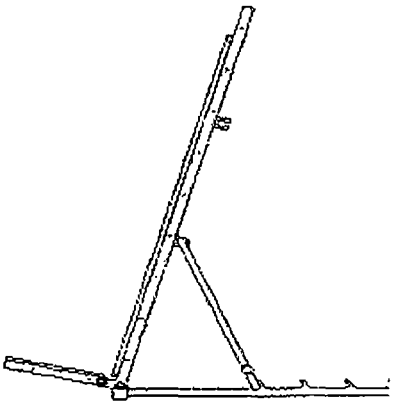
FIG. 7 depicts a side view of the slant board with a handled bar placed in the first notch in a notched base allowing the user to be most erect.

FIG. 7 shows a side view of a device with the handled bar placed in the first notch in said base. This provides the most erect position for the user. In this position the user could eat, work, and perform tasks comfortably.

Figure 8:
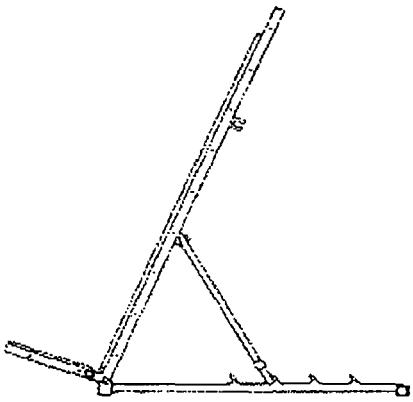
FIG. 8 depicts a side view of the slant board with said handled bar placed in the second notch in said base.

FIG. 8 shows a side view of the slant board with the handled bar in the second notch thus increasing the amount of reclining for the user.

Figure 9:
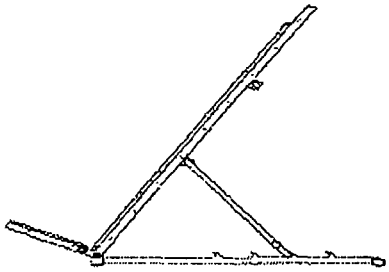
FIG. 9 depicts the side of the slant board with said handled bar placed in the third notch in said base.

FIG. 9 shows a side view of the slant board with the handled bar in the third notch achieving more recline for the user.

Figure 10:
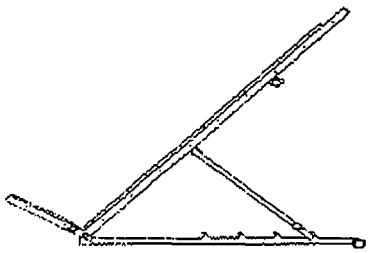
FIG. 10 depicts the side view of the slant board with said handle placed in the fourth notch on said base, achieving maximum recline.

FIG. 10 shows a side view of the slant board with the handled bar placed in the fourth notch thus achieving the maximum amount of reclining for the user. The user is encouraged to experiment with the various notches in the base to find the most comfortable position for performing various tasks or relaxing.

As disclosed in the description above and the figures, the handled bar 4 is manually placed in the selected notch 9 in the base 2, thus altering the angle of the panel to the most comfortable position for the user. However, such manual operations can be easily automated if desired, using designs that conform to current engineering and safety standards. The front and sides of the panel have holes 10 and 11, to accommodate the addition of electronic devices or padding to further add to the user's productivity and comfort while using the adjustable slant board. The present invention can be constructed with any appropriate lightweight and sturdy material, such as, aluminum, steel, PVC, carbon fiber, and other composite material or the like, which will be able to accommodate users of any size, weight and height.

While the present invention has been illustrated by a description of various aspects and features of the invention and while these aspects and features have been described in considerable detail, it is not the intention of the applicant to restrict or in any way limit the scope of the appended claims to such detail. Additional advantages and modifications will readily apparent to those skilled in the art. The invention in its broader aspects is therefore not limited to the specific details, representative apparatus and method, and illustrative examples shown and described. Accordingly, departures may be made from such details without departing from the spirit or scope of the applicant's general inventive concept.

What is claimed is:

1. An adjustable slant board comprising: a rigid panel (1) with front, back, and side surfaces; a base (2) including a plurality of notches (9); a folding footrest platform (3); a handled bar (4); wherein said panel (1) and said footrest platform (3) connect to said base (2) via a hinge (5); wherein said handled bar (4) is attached to a back surface of said panel (1) via a hinge (7) at a first end, with a second end of said handled bar (4) configured to be placed in a selected one of the notches (9) of the base (2) to adjust an angle of said panel (1), and a handle extends perpendicularly from said handled bar (4) intermediate the first and second ends of said handled bar (4); clips (8) on the back surface of the panel (1) for holding the handled bar (4) when folded towards the panel (1), with the clips (8) being located above the first end of the handled bar (4) on the back surface of the panel (1).

2. The adjustable slant board as recited in claim 1, wherein the folding footrest platform (3) folds down perpendicular to said rigid panel (1).

3. The adjustable slant board as recited in claim 1, wherein said rigid panel (1) has holes (10 and 11) in front and side surfaces for attaching additional accessories.

4. The adjustable slant board as recited in claim 1, wherein said panel (1) has a handle on top for hanging when stored.

5. The adjustable slant board as recited in claim 1, wherein said handled bar (4) pivots upwards when not in use and is secured in said clips (8) located on the back surface of said panel (1) thus collapsing said slant board into a more stream lined configuration.

6. The adjustable slant board as recited in claim 1, whereby said handled bar (4) is removed from said clips (8) securing it to the back surface of the panel (1), and pivots downward for placement in the selected one of the notches (9) in said base (2), thus altering the angle of the panel (1) to a more erect or more reclined position.

7. The adjustable slant board as recited in claim 1, wherein said base (2) has non-slip ends (6).

8. The adjustable slant board as recited in claim 1, wherein the footrest platform (3) folds upwards when said slant board is not in use.

* * * * *